US011306924B2

(12) United States Patent
Ryuu et al.

(10) Patent No.: US 11,306,924 B2
(45) Date of Patent: Apr. 19, 2022

(54) INDOOR UNIT FOR AIR CONDITIONING DEVICE

(71) Applicant: DAIKIN INDUSTRIES, LTD., Osaka (JP)

(72) Inventors: Jinfan Ryuu, Osaka (JP); Takashi Kashihara, Osaka (JP); Hironobu Teraoka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 68 days.

(21) Appl. No.: 16/345,924

(22) PCT Filed: Nov. 14, 2017

(86) PCT No.: PCT/JP2017/040989
§ 371 (c)(1),
(2) Date: Apr. 29, 2019

(87) PCT Pub. No.: WO2018/092783
PCT Pub. Date: May 24, 2018

(65) Prior Publication Data

US 2019/0331351 A1 Oct. 31, 2019

(30) Foreign Application Priority Data

Nov. 21, 2016 (JP) ..... JP2016-226307

(51) Int. Cl.
*F24F 1/0025* (2019.01)
*F24F 1/0067* (2019.01)
(Continued)

(52) U.S. Cl.
CPC ..... *F24F 1/0025* (2013.01); *F24F 1/0063* (2019.02); *F24F 1/0067* (2019.02); *F24F 13/30* (2013.01)

(58) Field of Classification Search
CPC ..... F24F 1/0025; F24F 1/0067; F24F 1/0063; F24F 13/30
See application file for complete search history.

(56) References Cited

U.S. PATENT DOCUMENTS 5,669,229 A * 9/1997 Ohbayashi ..... F24F 1/0047 62/259.1
5,944,481 A * 8/1999 Stone ..... F04D 29/441 415/53.1
(Continued)

FOREIGN PATENT DOCUMENTS

EP 2918924 A1 9/2015
JP 61089424 A * 5/1986 ..... F24F 1/0057
(Continued)

OTHER PUBLICATIONS

JP2006275488A mt (Year: 2006).*
(Continued)

*Primary Examiner* — Gordon A Jones
(74) *Attorney, Agent, or Firm* — Birch, Stewart, Kolasch & Birch, LLP

(57) ABSTRACT

Disclosed is an indoor unit of an air conditioner including: a casing; a cross-flow fan arranged in the casing and having a fan rotor and a tongue portion extending in an axial direction along an outer periphery of the fan rotor below the fan rotor and forward of a center axis of the fan rotor to define a suction port, the cross-flow fan forming in the casing an air flow directed from the rear to the front; and a heat exchanger arranged upstream of the fan in a direction of the air flow and having an inclined portion inclined to be positioned further downward toward a front side. The heat exchanger is arranged such that a front end of the inclined portion is located below the fan rotor and between a foremost portion and center axis of the fan rotor in a front-to-back direction.

4 Claims, 4 Drawing Sheets

(51) Int. Cl.
*F24F 1/0063* (2019.01)
*F24F 13/30* (2006.01)

(56) References Cited

U.S. PATENT DOCUMENTS

| | | | | |
|---|---|---|---|---|
| 9,546,823 | B2 * | 1/2017 | Lee | F28F 1/325 |
| 9,599,114 | B2 * | 3/2017 | Chen | F04D 29/4226 |
| 2009/0100858 | A1 * | 4/2009 | Park | F24F 1/0057 62/404 |
| 2010/0126206 | A1 * | 5/2010 | Park | F24F 1/0025 62/419 |
| 2014/0227961 | A1 * | 8/2014 | Yasutomi | F24F 11/72 454/325 |
| 2014/0301825 | A1 * | 10/2014 | Tian | F04D 29/30 415/53.1 |
| 2015/0211782 | A1 | 7/2015 | Ikeda et al. | |
| 2018/0023821 | A1 * | 1/2018 | Kim | F24F 13/28 62/264 |
| 2018/0112888 | A1 * | 4/2018 | Na | F04D 29/422 |

FOREIGN PATENT DOCUMENTS

| | | | | |
|---|---|---|---|---|
| JP | 8-327140 | A | 12/1996 | |
| JP | 2003-262353 | A | 9/2003 | |
| JP | 2006275488 | A * | 10/2006 | |
| JP | 2008-122056 | A | 5/2008 | |
| JP | 2008-275231 | A | 11/2008 | |
| JP | 2013076530 | A * | 4/2013 | F15C 4/00 |
| JP | 2016-80326 | A | 5/2016 | |
| WO | WO-2013094162 | A1 * | 6/2013 | F24F 1/0067 |
| WO | WO 2013/150568 | A1 | 10/2013 | |
| WO | WO-2013157403 | A1 * | 10/2013 | F25B 40/02 |
| WO | WO 2016/129379 | A1 | 8/2016 | |
| WO | WO-2018158940 | A1 * | 9/2018 | F24F 1/0011 |

OTHER PUBLICATIONS

WO-2013157403-A1 mt (Year: 2013).*
WO-2018158940-A1 mt (Year: 2018).*
WO-2013094162-A1 mt (Year: 2013).*
JP-2013076530-A MT (Year: 2013).*
JP-61089424-A MT (Year: 1986).*

* cited by examiner

INDOOR UNIT FOR AIR CONDITIONING DEVICE

TECHNICAL FIELD

The present invention relates to an indoor unit of an air conditioner provided with a cross-flow fan, particularly to a countermeasure to reduce air flow resistance of a heat exchanger.

BACKGROUND ART

An indoor unit of an air conditioner provided with a cross-flow fan has been known. Such a cross-flow fan includes a cylindrical fan rotor having a plurality of blades and rotates about a center axis thereof, and a housing having a suction port through which the air is taken in and a blow-out port through which the air is blown out, and houses therein the fan rotor (see, e.g., Patent Document 1 indicated below).

The indoor unit disclosed by Patent Document 1 includes a heat exchanger connected to a refrigerant circuit, a drain pan, a cross-flow fan, and a casing housing them. The cross-flow fan is provided in the casing having an air inflow port formed on a rear side and an outflow port formed on a front side. The cross-flow fan has a fan rotor rotating about a center axis thereof and a tongue portion, and is configured to form an air flow directed from the rear inflow port to the front outflow port in the casing by the rotation of the fan rotor. The heat exchanger is arranged upstream of the cross-flow fan in the direction of the air flow, and is configured to heat or cool the air passing therethrough. The drain pan is provided below the heat exchanger to receive condensation water generated on the heat exchanger.

Meanwhile, in the indoor unit, the heat exchanger is not arranged in a posture vertical to the air flow passing from the rear side to the front side in the casing (a vertical posture), but has an inclined portion which is inclined to be positioned further downward toward the front side in a front-to-back direction. In this indoor unit, the heat exchanger has the inclined portion inclined downward toward the front side. Thus, the heat exchanger with a relatively large heat transfer area can be installed in a relatively small casing.

CITATION LIST

Patent Document

[Patent Document 1] Japanese Unexamined Patent Publication No. 2008-275231

SUMMARY OF THE INVENTION

Technical Problem

However, in the indoor unit, an inclination angle of the inclined portion with respect to a vertical plane is too large. This leads to a problem in that the air flow resistance significantly increases at a lower end portion of the inclined portion which makes contact with the drain pan.

One of possible solutions to this problem is reducing the inclination angle of the inclined portion of the heat exchanger. However, reducing the inclination angle of the inclined portion requires the inclined portion to be shifted rearward to keep the inclined portion from making contact with the fan rotor.

If the inclined portion is shifted rearward to reduce the inclination angle thereof, the air flow resistance may be reduced, but the air flow that has passed through the heat exchanger may possibly fail to reach a foremost portion of the suction port (to the vicinity of the tongue portion). This results in a decrease in the effective suction area at the suction port of the cross-flow fan, thereby impairing the performance of the fan.

In view of the foregoing, it is an object of the present invention to reduce the air flow resistance of an indoor unit of an air conditioner provided with a cross-flow fan, without impairing the performance of the fan.

Solution to the Problem

A first aspect of the present disclosure is directed to an indoor unit of an air conditioner. The indoor unit includes: a casing (20) having an inflow port (21) formed on a rear side thereof, and an outflow port (22) formed on a front side thereof; a cross-flow fan (30) arranged in the casing (20) and having a fan rotor (31) rotating about a center axis (X) thereof and a tongue portion (36*a*) extending in an axial direction along an outer periphery of the fan rotor (31) below the fan rotor (31) and forward of the center axis (X) to define a suction port (32*a*), the cross-flow fan (30) forming in the casing (20) an air flow directed from the rear inflow port (21) to the front outflow port (22); and a heat exchanger (40) arranged upstream of the cross-flow fan (30) in the casing (20) in a direction of the air flow to heat or cool the air passing through the heat exchanger (40), the heat exchanger (40) having an inclined portion (44) which is inclined to be positioned further downward toward a front side in a front-to-back direction, wherein the heat exchanger (40) is arranged such that a front end (44*a*) of the inclined portion (44) is located below the fan rotor (31) and between a foremost portion (31*a*) and center axis (X) of the fan rotor (31) in the front-to-back direction.

A second aspect of the present disclosure is an embodiment of the first aspect of the present disclosure. In the second aspect, the heat exchanger (40) is arranged such that the front end (44*a*) of the inclined portion (44) is located below the fan rotor (31) and between the tongue portion (36*a*) and the center axis (X) in the front-to-back direction.

In the first and second aspects of the present disclosure, when the cross-flow fan (30) is operated, the air flow directed from the rear inflow port (21) to the front outflow port (22) is formed in the casing (20). The air that has flowed into the casing (20) via the inflow port (21) is heated or cooled when passing through the heat exchanger (40), so that the temperature is is adjusted. The air that has its temperature adjusted is sucked into, and blown out of, the cross-flow fan (30), and then flows out of the casing (20) through the outflow port (22).

In the first and second aspects of the present disclosure, the heat exchanger (40) has the inclined portion (44) which is inclined to be positioned further downward toward the front side in the front-to-back direction, and the front end (44*a*) of the inclined portion (44) is arranged below the fan rotor (31) and between the foremost portion (31*a*) and center axis (X) of the fan rotor (31) in the front-to-back direction. In particular, in the second aspect of the present disclosure, the heat exchanger (40) is arranged such that the front end (44*a*) of the inclined portion (44) is located below the fan rotor (31) and between the tongue portion (36*a*) and the center axis (X) in the front-to-back direction. As can be seen, in the first and second aspects of the present disclosure, the inclined portion (44) of the heat exchanger (40) is positioned further rearward than that of a heat exchanger of a conventional indoor unit having a front end positioned forward of the fan rotor. Therefore, in the casing (20), the inclined portion (44) of the heat exchanger (40) can be arranged in an inclined posture which is more vertical than that of the conventional heat exchanger.

In addition, in the first and second aspects of the present disclosure, the heat exchanger (40) is arranged such that the front end (44*a*) of the inclined portion (44) is positioned forward of the center axis (X) below the fan rotor (31). In other words, the front end (44*a*) of the inclined portion (44) is positioned near the tongue portion (36*a*) in the front-to-back direction. This can reduce the possibility that the air flow that passed through the heat exchanger (40) fails to reach the foremost portion of the suction port (32*a*) of the cross-flow fan (30), i.e., to the vicinity of the tongue portion (36*a*), thereby allowing the air to be sucked through every part of the suction port.

A third aspect of the present disclosure is an embodiment of the first or second aspect of the present disclosure. In the third aspect, the heat exchanger (40) has at least one bent portion, and is formed to surround the suction port (32*a*).

In the third aspect of the present disclosure, the heat exchanger (40) is formed into a bent shape to surround the suction port (32*a*). This makes it possible to further reduce the space for the arrangement of the heat exchanger (40) than the space for a heat exchanger which is not bent, but is in a linear shape.

A fourth aspect of the present disclosure is an embodiment of any one of the first to third aspects of the present disclosure. In the fourth aspect, the heat exchanger (40) is arranged such that a value obtained by dividing a shortest distance (A) between the heat exchanger (40) and the fan rotor (31) by an outer diameter (B) of the fan rotor (31) is not less than 0.125 and not more than 0.188.

In the fourth aspect of the present disclosure, the heat exchanger (40) is arranged to satisfy the expression: $0.125B \leq A \leq 0.188B$, where A is the shortest distance between a portion of the heat exchanger (40) closest to the fan rotor (31) and the fan rotor (31), and B is an outer diameter of the fan rotor (31).

Advantages of the Invention

According to the first and second aspects of the present disclosure, the heat exchanger (40), which is arranged upstream of the cross-flow fan (30) in the casing (20), is provided with the inclined portion (44) which is inclined to be positioned further downward toward the front side in the front-to-back direction, and the heat exchanger (40) is arranged such that the front end (44*a*) of the inclined portion (44) is positioned below the fan rotor (31) and between the foremost portion (31*a*) and center axis (X) of the fan rotor (31) in the front-to-back direction. In particular, according to the second aspect of the present disclosure, the heat exchanger (40) is arranged such that the front end (44*a*) of the inclined portion (44) is located below the fan rotor (31) and between the tongue portion (36*a*) and the center axis (X) in the front-to-back direction. This arrangement causes the inclined portion (44) of the heat exchanger (40) to be positioned further rearward than the inclined portion of the heat exchanger of the conventional indoor unit having the front end positioned forward of the fan rotor, which allows the inclined portion (44) to be arranged in an inclined posture which is more vertical than that of the conventional heat exchanger. This can further reduce the air flow resistance at the inclined portion (44) than that of the heat exchanger of the conventional indoor unit, and can reduce the energy consumption of the cross-flow fan (30).

Further, as described above, according to the first and second aspects of the present disclosure, the heat exchanger (40) is arranged such that the front end (44*a*) of the inclined portion (44) is positioned below the fan rotor (31) and near the tongue portion (36*a*) in the front-to-back direction. Even if the inclined portion (44) of the heat exchanger (40) is arranged further rearward than the conventional one, this arrangement can reduce the possibility that the air flow that passed through the heat exchanger (40) fails to reach the foremost portion of the suction port (30*a*) of the cross-flow fan (32), i.e., to the vicinity of the tongue portion (36*a*), thereby allowing the air to be sucked through every part of the suction port (32*a*). In other words, unlike the case where the inclined portion (44) of the heat exchanger (40) is positioned too rearward in the front-to-back direction, the effective suction area of the suction port (32*a*) of the cross-flow fan (30) does not decrease to impair the performance of the blower (30). Thus, according to the first and second aspects of the present disclosure, in an indoor unit of an air conditioner provided with the cross-flow fan (30), the air flow resistance can be reduced without impairing the performance of the fan (30).

According to the third aspect of the present disclosure, the heat exchanger (40) is formed into a bent shape, and is arranged to surround the suction port (32*a*). This makes it possible to further reduce the space for the arrangement of the heat exchanger than the space for a heat exchanger which is not bent, but is in a linear shape. In other words, this makes it possible to arrange the heat exchanger (40) having a relatively large heat transfer area in a small compact space around the suction port (32*a*).

DESCRIPTION OF EMBODIMENTS

An indoor unit of an air conditioner according to an embodiment of the present invention will be described with reference to the accompanying drawings. The following embodiments are merely exemplary ones in nature, and are not intended to limit the scope, applications, or use of the present invention.

<<First Embodiment of the Invention>>

Figure 1:
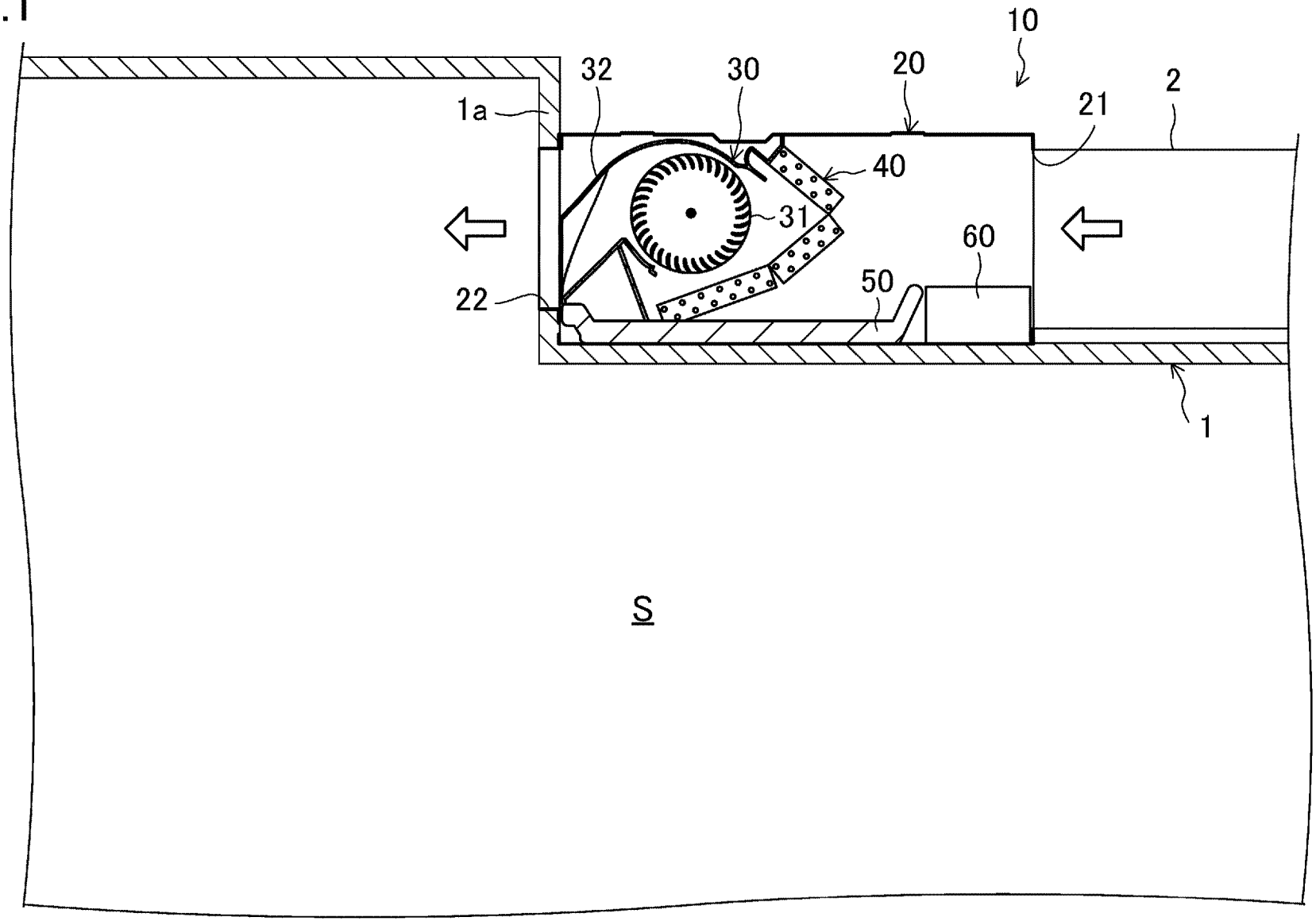
FIG. 1 is a sectional side view illustrating a state in which an indoor unit of an air conditioner according to an embodiment of the present invention is installed.

As shown in FIG. 1, an indoor unit (10) is installed in a clipped ceiling (1) whose ceiling surface is lowered from a main ceiling by one step. The indoor unit (10) includes a casing (20), a cross-flow fan (30), a heat exchanger (40), a drain pan (50), and an electric component box (60). The cross-flow fan (30), the heat exchanger (40), the drain pan (50), and the electric component box (60) are installed in the casing (20). In the following description, for convenience of explanation, the left side and right side of FIG. 1 will be referred to as the "front" and the "rear," and the front side and rear side in the direction perpendicular to the paper plane will be referred to as the "left" and the "right."

The casing (20) is formed as a box body having a substantially rectangular parallelepiped shape. Specifically, in FIG. 1, the casing (20) is configured as a thin, elongated box body having a greater dimension in a right-to-left direction than a dimension in a front-to-back direction, and a height smaller than the dimension in the front-to-back direction when viewed in plan. The casing (20) has an inflow port (21) formed at its rear surface, and an outflow port (22) formed at its front surface. A suction duct (2) has one end which is opened in an indoor space (S), and the other end connected to the inflow port (21). The outflow port (22) is formed like a duct, and penetrates a side surface (la) of the clipped ceiling (1) to communicate with the indoor space (S).

The cross-flow fan (30) has a fan rotor (31), a housing (32), and a motor (not shown). The cross-flow fan (30) is elongated in the right-to-left direction. When operated, the cross-flow fan (30) forms an air flow in the casing (20) directed from the rear inflow port (21) to the front outflow port (22).

Figure 2:
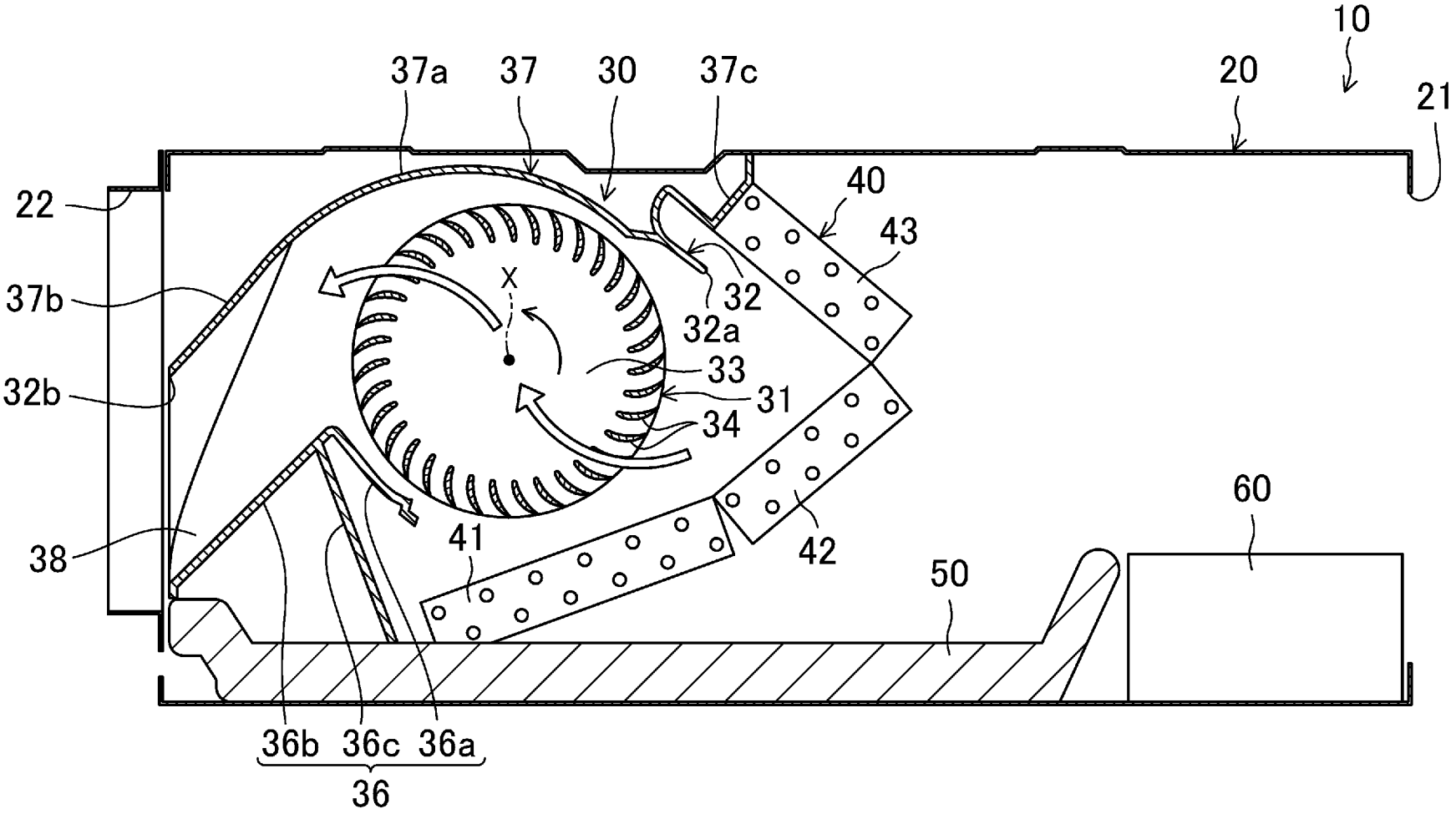
FIG. 2 is a sectional side view of the indoor unit of the air conditioner according to the embodiment of the present invention.
Figure 3:
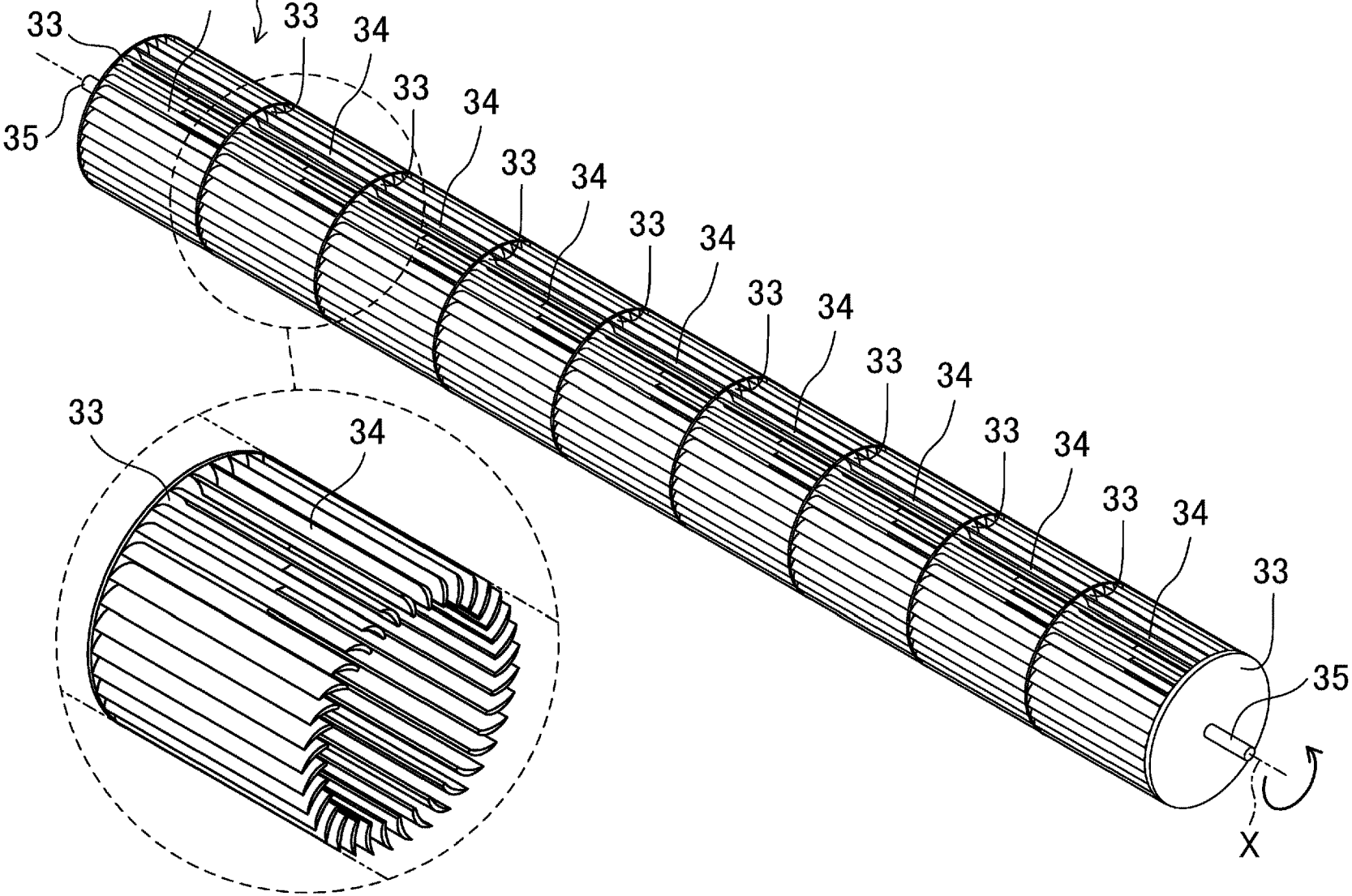
FIG. 3 is an enlarged perspective view illustrating a fan rotor of a cross-flow fan according to the embodiment of the present invention.

As shown in FIGS. 2 and 3, the fan rotor (31) includes ten disc-shaped partition plates (33), multiple blades (34), and two shafts (35). The ten partition plates (33) are spaced apart from one another with their centers aligned in a single straight line. Note that this straight line connecting the centers serves as a center axis (rotation axis) (X) of the fan rotor (31). The two shafts (35) are formed to respectively project outward from the centers of two outermost ones of the ten partition plates (33). One of the two shafts (35) is rotatably supported by a sidewall (38) of the housing (32), which will be described later, and the other shaft (35) is connected to the motor (not shown).

The multiple blades (34) are provided on outer peripheral portions of each pair of the ten partition plates (33) facing each other to extend between the pair of the partition plates (33). The multiple blades (34) are circumferentially spaced apart from one another. Further, each of the blades (34) is curved so as to bulge in the direction opposite to the rotation direction (direction indicated by the arrow in FIG. 2) in the circumferential direction of the fan rotor (31), and is arranged to be inclined such that an inner portion thereof in the radial direction of the fan rotor (31) is shifted toward the direction opposite to the rotation direction in the circumferential direction with respect to an outer portion thereof.

In this configuration, the fan rotor (31) is formed such that nine sets of a pair of partition plates (33) facing each other and a plurality of blades (34) connecting the outer peripheral portions of the pair of partition plates (33) are sequentially arranged in an axial direction.

Figure 4:
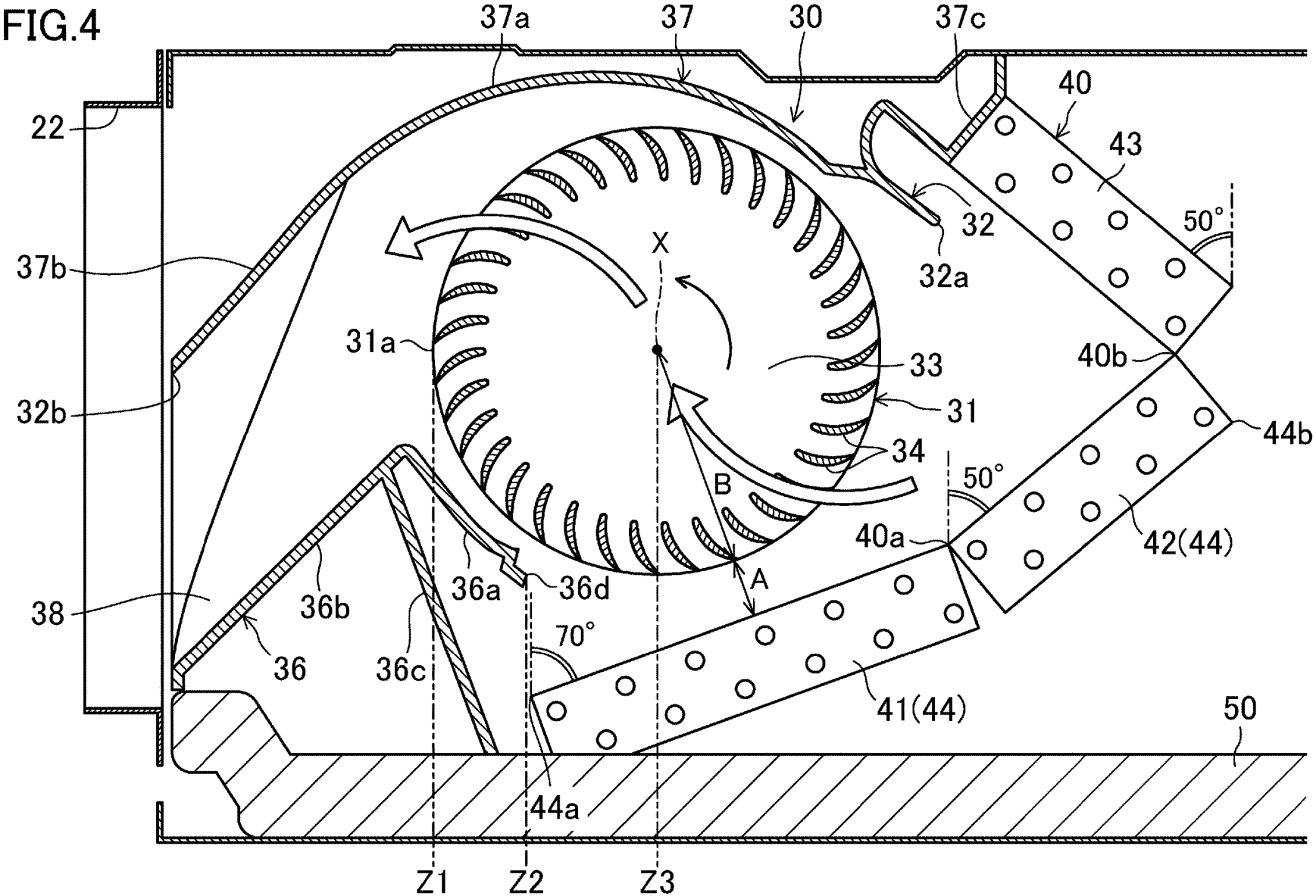
FIG. 4 is an enlarged view illustrating the cross-flow fan of FIG. 2 and the vicinity of a heat exchanger.

As shown in FIGS. 2 and 4, the housing (32) has a suction port (32*a*) for sucking the air and a blow-out port (32*b*) for blowing the air out, and is formed into a box-like shape so that the fan rotor (31) is housed therein. The housing (32) includes a lower wall (36) provided below the fan rotor (31), an upper wall (37) provided above the fan rotor (31), and two sidewalls (38) respectively provided at axial ends of the fan rotor (31).

The lower wall (36) is elongated in the axial direction of the fan rotor (31) below and forward of the fan rotor (31), and has a tongue portion (36*a*), a lower extension (36*b*), and a sealing portion (36*c*). The tongue portion (36*a*) is close to, and faces, a portion of the fan rotor (31) below and forward of the center axis (X), and is elongated in the axial direction of the fan rotor (31). A rearmost portion (36*d*) of the tongue portion (36*a*) forms the suction port (32*a*). The lower extension (36*b*) is continuous with an upper end of the tongue portion (36*a*) and extends obliquely downward from the upper end of the tongue portion (36*a*). A front end of the lower extension (36*b*) forms the blow-out port (32*b*). The sealing portion (36*c*) extends from the vicinity of the tongue portion (36*a*) on the lower surface of the lower extension (36*b*) to be located further rearward as it goes downward. A lower end of the sealing portion (36*c*) abuts on an upper surface of the drain pan (50) to seal a gap formed between the cross-flow fan (30) and the drain pan (50), thereby keeping the air that has passed through the heat exchanger (40) from bypassing the cross-flow fan (30) and flowing out of the casing (20).

The upper wall (37) is elongated in the axial direction of the fan rotor (31) above the fan rotor (31), and has a scroll wall portion (37*a*), an upper extension (37*b*), and a sealing portion (37*c*). The scroll wall portion (37*a*) is a wall portion formed in a spiral shape except for a rear end portion thereof, and elongated in the axial direction of the fan rotor (31) above the center axis (X) of the fan rotor (31) to cover the outer peripheral surface of the fan rotor (31). The scroll wall portion (37*a*) has a rear end which defines the suction port (32*a*), and extends forward from the suction port (32*a*) to a position immediately above an upper end portion of the tongue portion (36*a*). The upper extension (37*b*) is formed to be smoothly continuous with the front end of the scroll wall portion (37*a*). The upper extension (37*b*) extends substantially parallel to the lower extension (36*b*) to face the lower extension (36*b*), and has a front end which defines the blow-out port (32*b*). The sealing portion (37*c*) extends toward the top plate of the casing (20) while being bent in the shape of S from an upper surface of the rear end portion of the scroll wall portion (37*a*). The sealing portion (37*c*) partially abuts on the heat exchanger (40) to seal a gap formed between the suction port (32*a*) and the heat exchanger (40) so that the air that has flowed into the casing (20) through the inflow port (21) is blocked from bypassing the heat exchanger (40) and being sucked into the fan (30).

The two sidewalls (38), which are flat plates, are respectively provided at axial ends of the fan rotor (31) to block a gap formed between left ends of the lower wall (36) and the upper wall (37) and a gap formed between right ends of the lower wall (36) and the upper wall (37). Each of the two sidewalls (38) has an insertion hole through which an associated one of the shafts (35) of the fan rotor (31) is inserted. The two sidewalls (38) form an air flow path through which the air flows from the suction port (32*a*) toward the blow-out port (32*b*) between the lower wall (36) and the upper wall (37).

The heat exchanger (40) is provided in the casing (20) to be located rearward of the cross-flow fan (30), i.e., on an upstream side in the direction of the air flow formed by the fan (30). The heat exchanger (40) has two bent portions (40*a*, 40*b*), and thus, is formed into a bent shape. Specifically, the heat exchanger (40) has three heat exchange sections (first to third heat exchange sections (41 to 43)) formed by the two bent portions (40*a*, 40*b*). Just like the cross-flow fan (30), the first to third heat exchange sections (41 to 43) are elongated in the right-to-left direction (in the axial direction of the fan rotor (31)). Further, the first to third heat exchange sections (41 to 43) are arranged at mutually different angles to surround the suction port (32*a*) of the cross-flow fan (30). A specific arrangement of the first to third heat exchange sections (41 to 43) will be described later.

The drain pan (50) is provided below the heat exchanger (40) in the casing (20) to receive condensation water generated on the surface of the heat exchanger (40). When viewed in plan, the drain pan (50) has a dimension in the right-to-left direction and a dimension in the front-to-back direction which are greater than the associated dimensions of the heat exchanger (40), and has an outer peripheral portion which is raised upward to form an outer peripheral wall blocking the received condensation water from overflowing. The drain pan (50) is mounted on a bottom plate of the casing (20). The condensation water received by the drain pan (50) is discharged to the outside via a drain hose (not shown).

The electric component box (60) is provided on a rear end portion of the bottom plate in the front-to-back direction in which the inflow port (21) and the outflow port (22) of the casing (20) face each other. Specifically, in the direction of the air flow formed in the casing (20), the electric component box (60) is disposed upstream of the heat exchanger (40) on which the condensation water is generated and the drain pan (50) which receives the condensation water. The electric component box (60) is spaced apart from the outer peripheral wall of the drain pan (50), and has a smaller height than the drain pan (50).

<Detailed Arrangement of Heat Exchanger>

As described above, the heat exchanger (40) has the two bent portions (40*a*, 40*b*), and the first to third heat exchange sections (41 to 43) are formed by the two bent portions (40*a*, 40*b*). Specifically, the first heat exchange section (41) and the second heat exchange section (42) are formed with the first bent portion (40*a*) interposed therebetween, and the second heat exchange section (42) and the third heat exchange section (43) are formed with the second bent portion (40*b*) interposed therebetween. The first heat exchange section (41) and the second heat exchange section (42) are configured as an inclined portion (44) which is inclined with respect to a vertical plane parallel to the center axis (X) of the fan rotor (31) to be positioned downward toward the front side in the front-to-back direction. Conversely, the third heat exchange section (43) is inclined to be positioned further upward toward the front side in the front-to-back direction.

The inclined portion (44) formed by the first and second heat exchange sections (41) and (42) has a front end (44*a*) which is located below the fan rotor (31) and between a foremost portion (31*a*) and center axis (X) of the fan rotor (31) in the front-to-back direction, and a rear end (44*b*) which is located at substantially the same level as the center axis (X) behind the fan rotor (31). More specifically, in the front-to-back direction, the front end (44*a*) of the inclined portion (44) is located between a vertical plane Z1 which is in contact with the foremost portion (31*a*) of the fan rotor (31) and a vertical plane Z3 which passes through the center axis (X). In more detail, in this embodiment, the front end (44*a*) of the inclined portion (44) is located between a vertical plane Z2 which is in contact with the rearmost portion (36*d*) of the tongue portion (36*a*) and the vertical plane Z3 which passes through the center axis (X) in the front-to-back direction, and in particular, is located immediately behind the rear end of the tongue portion (36*a*).

The first and second heat exchange sections (41) and (42) constituting the inclined portion (44) are inclined at different inclination angles with respect to a vertical plane parallel to the center axis (X) of the fan rotor (31), which will be hereinafter simply referred to as "vertical inclination angles," due to the presence of the first bent section (40*a*). Specifically, the second heat exchange section (42) on the rear side is inclined at a smaller vertical inclination angle than the first heat exchange section (41) on the front side. In this embodiment, the first heat exchange section (41) and the second heat exchange section (42) are respectively inclined at vertical inclination angles of 70° and 50°.

The third heat exchange portion (43) is inclined in a manner different from the inclined portion (44) due to the presence of the second bent portion (40*b*). In this embodiment, the third heat exchange section (43) is inclined in a direction opposite to the inclined portion (44) with respect to the vertical plane parallel to the center axis (X) of the fan rotor (31) at a vertical inclination angle of 50° (−50° if the vertical inclination angle of the second heat exchange section (42) is positive). In this embodiment, the third heat exchange section (43) is formed symmetrically with the second heat exchange section (42) with respect to a horizontal plane. Therefore, the front and rear ends of the second heat exchange section (42) are at the same positions as the front and rear ends of the third heat exchange section (43) in the front-to-back direction. In this embodiment, the second bent portion (40*b*) between the second heat exchange section (42) and the third heat exchange section (43) is at the same height position as the center axis (X) of the fan rotor (31).

In this way, the first to third heat exchange sections (41 to 43) of the heat exchanger (40) are arranged at mutually different vertical inclination angles to surround the suction port (32*a*) of the cross-flow fan (30). Further, the heat exchanger (40) is arranged such that the first heat exchange section (41) is located closest to the fan rotor (31) to satisfy the expression: $0.125 \leq A/B \leq 0.188$ ($0.125B \leq A \leq 0.188B$), where A is the shortest distance between the first heat exchange section (41) and the fan rotor (31), and B is an outer diameter of the fan rotor (31).

In this embodiment, assuming that the outer diameter B of the fan rotor (31) is 80 mm to 120 mm, the shortest distance A is set to be 15 mm.

<<Differences from Conventional Indoor Unit>>

In this embodiment, as described above, the heat exchanger (40) is provided so that the front end (44*a*) of the inclined portion (44) is positioned below the fan rotor (31) and between the center axis (X) and the tongue portion (36*a*) in the front-to-back direction. In this embodiment, the heat exchanger (40) arranged in this manner in the casing (20) causes the inclined portion (44) to be positioned further rearward than an inclined portion (44) of a heat exchanger of a conventional indoor unit having a front end (44*a*) positioned forward of a foremost portion (31*a*) of a fan rotor (31). Therefore, the inclined portion (44) can be arranged in an inclined posture which is more vertical than the conventional one. The inclined portion (44) arranged in the more vertical posture reduces the air flow resistance at a lower end portion thereof (a lower end portion of the first heat exchange section (41)) than in the conventional indoor unit.

—Operation—

When the cross-flow fan (30) is activated in the indoor unit (10) of the air conditioner, the fan rotor (31) rotates to form an air flow penetrating the fan rotor (31) in the housing (32) (see white arrows in FIG. 2). In this way, the air in the casing (20) is sucked through the suction port (32*a*), penetrates the fan rotor (31), and is blown out of the blow-out port (32*b*). The cross-flow fan (30) operated in this manner forms an air flow directed from the inflow port (21) to the outflow port (22) in the casing (20). As a result, the air in the indoor space (S) flows into the casing (20) via the suction duct (2). The air that has flowed into the casing (20) through the inflow port (21) exchanges heat with the refrigerant when passing through the heat exchanger (40), and has its temperature adjusted (heated or cooled). The air having its temperature adjusted is sucked into the fan (30), flows through an air flow path formed in the housing (32), and is blown out of the blow-out port (32*b*). The air blown out of the fan (30) is supplied into the indoor space (S) through the outflow port (22). This air adjusts the temperature of the air in the indoor space (S).

<Air Flow Passing through Heat Exchanger>

In this embodiment, as described above, the inclined portion (44) of the heat exchanger (40) is positioned further rearward in the front-to-back direction than that of the conventional indoor unit. Thus, the inclined portion (44) can be arranged in an inclined posture which is more vertical than the conventional one. Since the inclined portion (44) is provided in the more vertical posture, the air flow resistance at the lower end portion of the inclined portion (44) (the lower end portion of the first heat exchange section (41)) is further reduced than that in the conventional indoor unit.

Further, in this embodiment, as described above, the inclined portion (44) is positioned further rearward in the front-to-back direction than that of the heat exchanger of the conventional indoor unit, but is not located too rearward, and the front end (44*a*) of the inclined portion (44) is located near the tongue portion (36*a*). This can reduce the possibility that the air flow that has passed through the heat exchanger (40) fails to reach the foremost portion of the suction port (32*a*) of the cross-flow fan (30) (the vicinity of the tongue portion (36*a*)), thereby allowing the air to be sucked through every part of the suction port (32*a*).

—Advantages of First Embodiment—

As can be seen, according to this embodiment, the heat exchanger (40) arranged upstream of the cross-flow fan (30) in the casing (20) is provided with the inclined portion (44) which is inclined to be positioned further downward toward the front side in the front-to-back direction. Further, the heat exchanger (40) is arranged so that the front end (44*a*) of the inclined portion (44) is located below the fan rotor (31) and between the foremost portion (31*a*) and center axis (X) of the fan rotor (31) in the front-to-back direction. In particular, in this embodiment, the heat exchanger (40) is arranged so that the front end (44*a*) of the inclined portion (44) is positioned below the fan rotor (31) and between the tongue portion (36*a*) and the center axis (X) in the front-to-back direction. This arrangement causes the inclined portion (44) of the heat exchanger (40) to be positioned further rearward than the inclined portion of the heat exchanger of the conventional indoor unit having the front end positioned forward of the fan rotor, which allows the inclined portion (44) to be arranged in an inclined posture which is more vertical than that of the conventional heat exchanger. This can further reduce the air flow resistance at the inclined portion (44) than that of the heat exchanger of the conventional indoor unit, and can reduce the energy consumption of the cross-flow fan (30).

Further, according to this embodiment, the heat exchanger (40) is arranged such that the front end (44*a*) of the inclined portion (44) is located below the fan rotor (31) and near the tongue portion (36*a*) in the front-to-back direction. Even if the inclined portion (44) of the heat exchanger (40) is arranged further rearward than the conventional one, this arrangement can reduce the possibility that the air flow that passed through the heat exchanger (40) fails to reach the foremost portion of the suction port (30*a*) of the cross-flow fan (32), i.e., to the vicinity of the tongue portion (36*a*), thereby allowing the air to be sucked through every part of the suction port (32*a*). In other words, unlike the case where the inclined portion (44) of the heat exchanger (40) is positioned too rearward in the front-to-back direction, the effective suction area of the suction port (32*a*) of the cross-flow fan (30) does not decrease to impair the performance of the blower (30). Thus, according to this embodiment, in an indoor unit of an air conditioner having the cross-flow fan (30), the air flow resistance can be reduced without impairing the performance of the fan (30).

Moreover, according to this embodiment, the heat exchanger (40) is formed into a bent shape having the two bent portions (40*a*, 40*b*), and is arranged to surround the suction port (32*a*). This makes it possible to further reduce the space for the arrangement of the heat exchanger than the space for a heat exchanger which is not bent, but is in a linear shape. In other words, the indoor unit of the present embodiment makes it possible to arrange the heat exchanger (40) having a relatively large heat transfer area in a small compact space around the suction port (32*a*).

<<Other Embodiments>>

In the above-described embodiments, an indoor unit installed in a ceiling has been described as an example of the indoor unit including the cross-flow fan of the present invention. However, the indoor unit of the present invention is not limited to the one installed in the ceiling. The indoor unit may be installed in an indoor space.

In addition, it has been described in the above embodiments that the indoor unit (10) includes the casing (20) provided with the inflow port (21) and the outflow port (22) respectively formed through two side surfaces facing each other. However, the positions of the inflow port (21) and the outflow port (22) in the casing (20) are not limited to those described above. For example, the inflow port (21) may be formed at a rear portion of a bottom surface of the casing (20), and the outflow port (22) may be formed at a front portion of the bottom surface of the casing (20).

Further, it has been described in the above embodiments that the heat exchanger (40) has the two bent portions (40*a*, 40*b*), and is formed into a bent shape in which the two bent portions (40*a*, 40*b*) connect the three heat exchange sections (first to third heat exchange sections (41 to 43)) arranged at different angles. However, the heat exchanger (40) may be in a linear shape with no bents. If the heat exchanger (40) is in a linear shape, the whole part of the heat exchanger (40) becomes the inclined portion (44). When the heat exchanger (40) is arranged such that its front end (44*a*) is located between the foremost portion (31*a*) and center axis (X) of the fan rotor (31) in the front-to-back direction, the same advantages as those of the present embodiment can be obtained. The heat exchanger (40) may have one bent portion, or may have three or more bent portions.

INDUSTRIAL APPLICABILITY

As can be seen, the present invention relates to an indoor unit of an air conditioner provided with a cross-flow fan, and is particularly useful as a countermeasure to reduce air flow resistance of a heat exchanger.

DESCRIPTION OF REFERENCE CHARACTERS

10 Indoor Unit
20 Casing
21 Inflow Port
22 Outflow Port
30 Fan
31 Fan Rotor
31*a* Foremost Portion
32*a* Suction Port
36*a* Tongue Portion
40 Heat Exchanger

40*a* First Bent Portion
40*b* Second Bent Portion
44 Inclined Portion
44*a* Front End
X Center Axis

The invention claimed is:

1. An indoor unit of an air conditioner, the indoor unit comprising:

a casing having an inflow port formed on a rear side of the casing, and an outflow port formed on a front side of the casing;

a cross-flow fan arranged in the casing and having a fan rotor rotating about a center axis of the cross-flow fan and a tongue portion extending in an axial direction along an outer periphery of the fan rotor below the fan rotor and forward of the center axis to define a suction port, the cross-flow fan forming in the casing an air flow directed from the inflow port on the rear side of the casing to the outflow port on the front side of the casing; and a heat exchanger arranged upstream of the cross-flow fan in the casing in a direction of the air flow to heat or cool the air passing through the heat exchanger, the heat exchanger having an inclined portion which is inclined to be positioned further downward toward a front side in a front-to-back direction, wherein the inflow port is formed at a rear surface of the casing, and the heat exchanger is arranged such that a front end of the inclined portion defined by a corner of the entire heat exchanger is located below the fan rotor, and between a foremost portion of the fan rotor and the center axis of the fan rotor in the front-to-back direction, the heat exchanger has first and second bent portions located rearward of the fan rotor in the front-to-back direction, and is formed such that first, second, and third heat exchange sections formed by the first and second bent portions are arranged at mutually different angles to surround the suction port, the first heat exchange section and the second heat exchange section behind the first heat exchange section are the inclined portion which is inclined to be positioned further downward toward the front side in the front-to-back direction, an end of the third heat exchange section abuts on a sealing portion of a housing of the cross-flow fan, and the end of the third heat exchange section that abuts on the sealing portion is located at a position vertically overlapping with a front end portion of the second heat exchange section.

2. The indoor unit of claim 1, wherein the heat exchanger is arranged such that the front end of the inclined portion is located below the fan rotor, and between an end of the tongue portion and the center axis of the fan rotor in the front-to-back direction, wherein the end of the tongue portion faces the heat exchanger.

3. The indoor unit of claim 1, wherein the heat exchanger is arranged such that a value obtained by dividing a shortest distance between the heat exchanger and the fan rotor by an outer diameter of the fan rotor is not less than 0.125 and not more than 0.188.

4. The indoor unit of claim 2, wherein the heat exchanger is arranged such that a value obtained by dividing a shortest distance between the heat exchanger and the fan rotor by an outer diameter of the fan rotor is not less than 0.125 and not more than 0.188.

* * * * *